United States Patent [19]

Lowe et al.

[11] Patent Number: 4,723,583

[45] Date of Patent: Feb. 9, 1988

[54] CATCH BASKET FOR APPLIANCES

[76] Inventors: Gordon M. Lowe; Patrice P. Lowe, both of 384 E. Canyon Country Rd., Brea, Calif. 92621

[21] Appl. No.: 904,366

[22] Filed: Sep. 8, 1986

[51] Int. Cl.[4] ..... B65D 37/00

[52] U.S. Cl. ..... 150/49; 150/51; 68/3; 220/18; 206/320

[58] Field of Search ..... 68/3 R, 13 R; 150/48, 150/49, 50, 51; 206/320, 576; 220/18, 18.1

[56] References Cited

U.S. PATENT DOCUMENTS

| | | | |
|---|---|---|---|
| 1,216,945 | 2/1917 | Christie | 150/49 X |
| 2,061,302 | 11/1936 | Egler | 150/51 X |
| 3,716,938 | 2/1973 | Ammons | 150/49 X |

FOREIGN PATENT DOCUMENTS

| | | | |
|---|---|---|---|
| 11600 | of 1913 | United Kingdom | 150/49 |
| 1106806 | 3/1968 | United Kingdom | 150/51 |

*Primary Examiner*—William Price

[57] ABSTRACT

A catch basket for use in combination with a large appliance wherein the appliance is spaced from an adjacent dwelling wall. The catch basket includes a substantially rigid three-sided frame member together with expansion means for securing the frame member within the space between the appliance and the adjacent wall and to the appliance. Flexible basket means are attached to the rigid frame and extend across the spacing between the appliance and the wall. Means are further provided whereby the flexible basket means may adjust for and accommodate existing irregularities of the adjacent wall.

10 Claims, 5 Drawing Figures

CATCH BASKET FOR APPLIANCES

FIELD OF THE INVENTION

This invention relates generally to large appliances, such as washers or dryers, and particularly to those used in close proximity to dwelling enclosure walls.

BACKGROUND OF THE INVENTION

In the majority of laundry room or utility room situations found both in residential use as well as those in commercial use, the washer and dryer appliances are situated with their respective back surfaces facing a dwelling wall. In most circumstances, the various connections and couplings made to the washer and dryer appliances, such as those for electrical, gas, water or ventilation, make their respective connections at the back surface of the appliance. As a result, the typical washer or dryer appliance is not usually found with its back surface against the nearby dwelling wall, but is generally required to be spaced from the dwelling wall a sufficient distance to permit clearance between the various connections and couplings to the machine. In addition, laundry or utility rooms frequently have one or more sets of pipes extending across the wall surface which further precludes the positioning of the washer or dryer appliance tightly against the wall. As a result, in the typical washer or dryer arrangement there exists a space of approximately 6 to 10 inches between the rear surface of the washer or dryer appliance and the closest dwelling wall.

In use, a problem frequently arises in that objects being places within, removed from or collected on top of the washer and dryer appliances often fall behind the appliance due to the above-described spacing between its rear surface and the wall. Because washer and dryer appliances are extremely heavy and therefore difficult to move, they may not be readily pulled from the wall to permit retrieval of these articles or objects without considerable effort and inconvenience. In addition, the typical utility room or laundry room environment often includes overhead cabinets, shelves or the like which further exaserbate the problem of retrieving such objects by making it even more difficult to gain access to the space between the appliance and the dwelling wall.

In addition to the problems of objects being inadvertantly dropped behind the washer or dryer appliance during the transfer of clothing articles and the like to and from the appliance, the typical washer or dryer is designed with a raised control panel at the rear of the machine which in turn often defines a small flat upper surface. This small upper surface often becomes a convenient surface upon which to place various articles associated with the laundering process or otherwise related to it, such as material removed from garmet pockets and so on. Such articles placed upon this rear upper surface also tend to be inadvertently knocked bacwardly and fall into the spacing between the rear of the washer or dryer and the dwelling wall.

There arises therefore a need in the art for a convenient system for retrieving such articles which inadvertently fall between the washer or dryer appliance and the adjacent wall surface.

SUMMARY OF THE INVENTION

Accordingly, it is a general object of the present invention to provide for the easy retrieval of objects inadvertently falling between the rear surface of a washer or dryer or the like and the adjacent dwelling wall. It is a more particular object of the present invention to provide for the easy retrieval of such objects while avoiding the difficulty and inconvenience of moving the washer or dryer appliances.

In accordance with the present invention there is provided a catch basket for use in combination with a large appliance wherein the appliance is spaced from an adjacent dwelling wall. The catch basket includes a substantially rigid three-sided frame member together with expansion means for securing the frame member within the space between the appliance and the adjacent wall and to the appliance. Flexible basket means are attached to the rigid frame and extend across the spacing between the appliance and the wall. Means are further provided whereby the flexible basket means may adjust for and accommodate existing irregularities of the adjacent wall.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
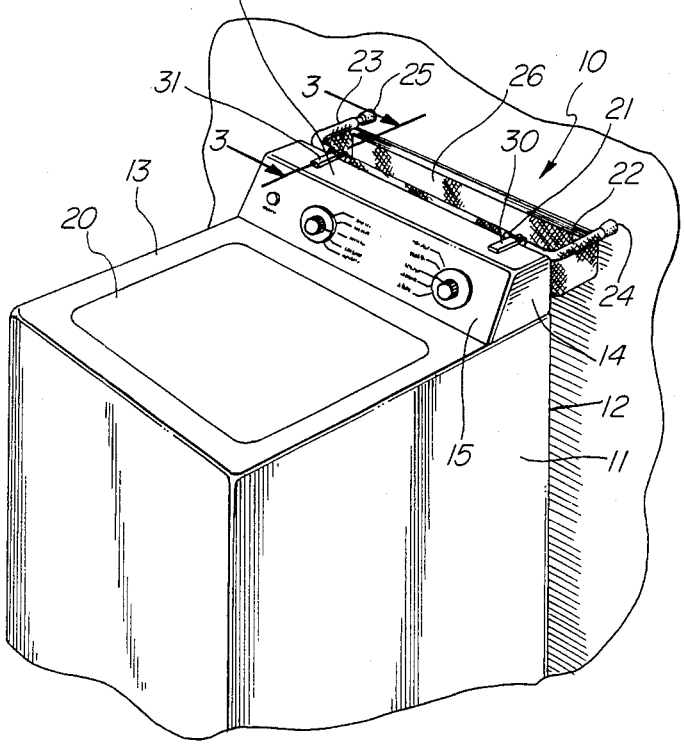
FIG. 1 is a perspective view of the present invention catch basket as used in combination with a conventional washing machine.

FIG. 1 shows a perspective view of a typical installation of the present invention catch basket 10 in which a washing machine 11, constructed in accordance with well known washing machine fabrication techniques, includes a top surface 13, a rear surface 12 and an access door 20 defined in top surface 13. Washing machine 11 further includes a control housing 14, generally situated along the rear portion of top surface 13, and including a control panel 15 and a control panel top 16. In the situation shown in FIG. 1, washer 11 is installed in a position generally parallel to, but spaced from wall surface 32 such that a space between rear surface 12 and wall surface 32 exists.

A catch basket 10 constructed in accordance with the present invention is supported in the intervening space between rear surface 12 of control housing 14 and wall surface 32. Catch basket 10 includes a generally U-shaped frame 21 formed of a rigid material which in turn defines a straight portion 35 resting against rear surface 32 and extending across a substantial portion of the span of control panel top 16 and a pair of rearwardly extending legs 22 and 23. The latter terminates in a foot 24 and a foot 25 respectively which, as described below in greater detail, contact wall surface 32 and frictionally engage the wall surface. A pair of tabs 31 and 32 are attached to straight portion 35 and extend forwardly therefrom to position U-frame 21 with respect to control panel top 16. By means described below in greater detail, a flexible basket 26 is secured to U-frame 21 and extends downwardly therefrom and spans the majority of the above-described space between rear surface 12 and wall surface 32.

In accordance with the invention, the support of basket 26 between rear surface 12 of washer 11 and wall surface 32 provides a receptacle within which objects which otherwise fall to the floor between rear surface 12 and wall surface 32 and are difficult to retrieve, are instead caught within basket 26 and maintain therein and are thus readily retrievable without the need of moving washer 11 or requiring access to the space between rear surface 12 and wall surface 32.

The means by which catch basket 10 is supported in the manner indicated in FIG. 1 are described below in greater detail. However, suffice it to state here that the cooperation of foot 24, foot 25 and tabs 30 and 31 are operative to secure U-frame 22 without the use of fasteners of any kind in either wall surface 32 or washer 11. In accordance with the descriptions in greater detail set forth below, it should also be noted that catch basket 10 includes means which accommodate substantial variation in the space between rear surface 12 and wall surface 32. As a result, catch basket 10 is capable of use in a variety of positions of washer 11. It should also be noted that while the illustration set forth in FIG. 1 is that relating to the use of the present invention catch basket in combination with a washing machine, it will be apparent to those skilled in the art that the present invention catch basket is equally capable of use in combination with other large appliances, such as dryers or stoves or the like.

Figure 2:
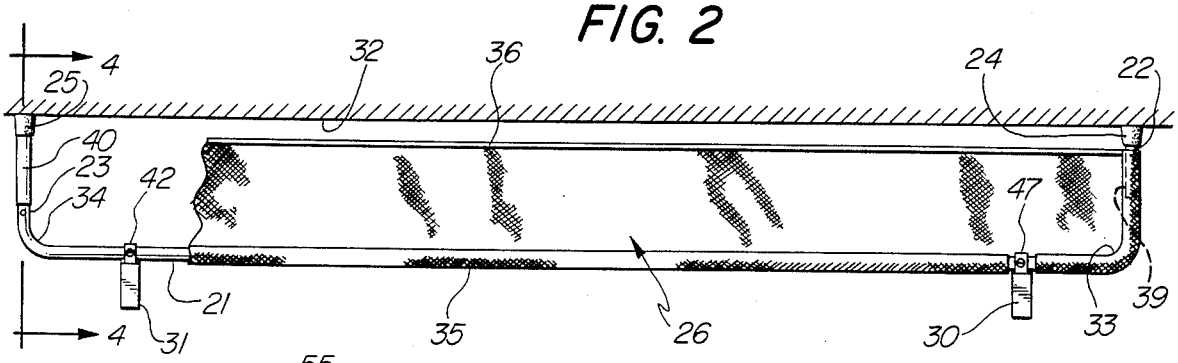
FIG. 2 is a partially sectioned top view of a catch basket constructed in accordance with the present invention.

FIG. 2 shows a top view of the present invention catch basket in which U-frame 21 is formed of a metal tube and defines a straight portion 35 which terminates in a pair of bends 33 and 34 at each end and a pair of rearwardly extending legs 22 and 23. Legs 22 and 23 are coupled to a pair of expansion joints 39 and 40 respectively which in turn are coupled to a foot 24 and a foot 25 respectively. A tab 31 is secured to straight portion 35 of U-frame 21 by a loop 42 and extends outwardly from U-frame 21. Similarly, a tab 30 is secured to straight portion 35 of U-frame 21 by a loop 47. The structure of tab 31 and loop 42 is set forth in greater detail in FIG. 3. However, suffice it to note here that tabs 30 and 31 are spaced apart a sufficient distance to provide a stable pair of resting surfaces upon which catch basket 10 may rest upon control panel top 16 of washer 11. Foot 24 and foot 25 are formed of a rubber or resilient plastic-like material and function to create a frictional contact with wall surface 32. As mentioned above, and in accordance with an important aspect of the present invention, foot 24 and foot 25 engage wall surface 32 without the use of any fastener or permanent attachment to the wall surface. Therefore, the present invention catch basket may readily be removed from wall surface 32 without having caused any damage thereto. Similarly, it should be noted that tabs 30 and 31 rest upon the engaging surface of the appliance, such as control panel top 16 of washer 11 shown in FIG. 1, without the use of any permanent attachment to the appliance, thereby avoiding any potential damage or disfigurement of the machine and further facilitating the easy removal of the present invention catch basket for cleaning or other reasons. In accordance with structures set forth below in greater detail, expansion joints 39 and 40 are operative to provide an expandable coupling between legs 22 and 23 respectively and foot 24 and foot 25 respectively to exert an expanding force against wall surface 32 which further enhances the frictional contact between foot 24 and foot 25 against wall surface 32. Basket 26 is formed of a flexible cloth-like or net material in its preferred form and extends from U-frame 21 rearwardly and terminates on its back edge at an elastic 36. Elastic 36 is stretched between expansion joint 39 and 40 and is formed of a resilient material having sufficient elasticity to support the rear portion of basket 26. In accordance with an important aspect of the present invention, the use of elastic 36 to provide the back support means of basket 26 permits basket 26 to conform to irregularities in wall surface 32, such as would occur in the presence, for example, of plumbing fixtures, pipes or electrical conduits being secured to wall surface 32. In such case, elastic 36 rests against such wall surface irregularities and is deformed inwardly from the straight line position shown in FIG. 2 to permit basket 26 to accommodate such wall surface irregularities.

Figure 3:
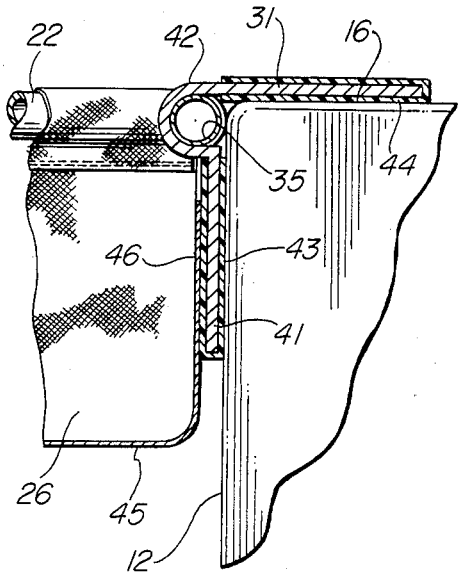
FIG. 3 is a partial section view of a catch basket constructed in accordance with the present invention taken along section lines 3—3 in FIG. 1.

FIG. 3 is a section view of the present invention catch basket taken along section lines 3—3 in FIG. 1 and shows the details of the attachment of the present invention catch basket to control panel top 16 of washer 11. Accordingly, tab 31 extends across a portion of control panel top 16 and by attachment of loop 42, tab 31 is secured to straight portion 35 of U-frame 21. In addition, the present invention catch basket defines a downwardly extending tab 41 attached to loop 42 and secured to straight portion 35 in a similar manner to that of tab 31. Tab 41 rests against rear surface 12 of washer 11 and is maintained in contact therewith by the expansion force created by expansion joints 39 and 40 (seen in FIG. 2). Basket 26, which, as described above, is preferably formed of a flexible cloth-like material, defines an elongated trough in the interior of U-frame 21 and extends downwardly therefrom. Basket 26 defines a basket side 46 extending downwardly from straight portion 35 and terminates in a basket bottom 45 which spans substantially all of the space between rear surface 12 of washer 11 and wall surface 32. While any number of means of attachment for basket 26 to U-frame 21 may be utilized without departing from the spirit and scope of the present invention. It has been found advantageous to secure basket 26 to U-frame 21 by folding the upper portion of basket side 46 in a peripheral fold and securing the lower portion of the fold thus formed to basket side 46 beneath U-frame 21 and thus form a sheath 50 about the perimeter of basket 26 which encloses U-frame 21 and elastic 36. It should be understood that tabs 30 and 31 are of substantially identical construction and that tab 30 includes a downwardly extending tab identical to tab 41 which is not seen in the figures, but which cooperates with tab 30 in the same manner as tab 41 cooperates with tab 31 to secure the position of U-frame 21 with respect to control panel top 16 and rear surface 12 of washer 11. Tabs 31 and 41 are covered by resilient sleeves 44 and 43 respectively which in the preferred form comprise a layer of rubber or elastic material suitable for producing a frictional engagement with the underlying surfaces of washing machine 11 and thereby enchancing the attachment of catch basket 10 shown in FIG. 1. Similarly, tabs 31 and the downwardly extending tab therefrom (not shown) also support resilient sleeves identical to resilient sleeves 43 and 44 in FIG. 3.

Figure 4:
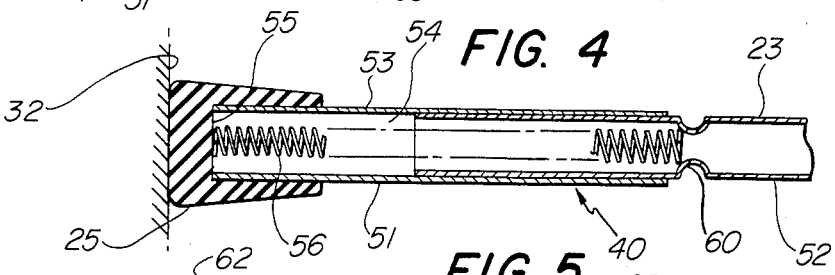
FIG. 4 is a section view of a portion of the present invention catch basket taken along section lines 4—4 in FIG. 2.

FIG. 4 shows a section view of expansion joint 40 in which foot 25 which, as mentioned, is formed of a rubber or resilient plastic material, is in contact with wall surface 32 and defines an interior cup 55. A hollow tube 51 is received on one end within cup 55 and maintained therein by the frictional engagement of the interior of cup 55 and the outer surface of tube 51. Tube 51 comprises a rigid wall 53 and an interior passage 54 which is sized to receive the end portion of leg 23. Leg 23 further defines a cylindrical wall 52 which in turn defines a reduced neck 60 extending inwardly. A spring 56 is compressively captivated between the bottom portion of cup 55 and neck 60. In the attached position, such as that shown in FIG. 1, expansion joint 40 is initially contracted by forcing leg 23 toward foot 25 such that leg 23 travels within interior passage 54 of tube 51. The inward motion of leg 23 within tube 51 during this contraction is resisted by compressed spring 56 which exerts an expanding force against cup 55 and neck 60 which tends to drive leg 23 outwardly from tube 51.

Expansion joint 39, foot 24 and leg 22 are identical in construction to expansion joint 40, foot 25 and leg 23 respectively and are operated in the same manner. Thus, the attachment of catch basket 10 in the position shown in FIG. 1, is carried forward by initially placing foot 24 and foot 25 against wall surface 32 and forcing U-frame 21 toward wall surface 32 to contract expansion joints 39 and 40. Thereafter, and with expansion joints 39 and 40 sufficiently contracted, tabs 30 and 31 are positioned in the manner shown in FIG. 1 and the contracting force against U-frame 21 is relaxed, which permits expansion joints 30 and 40 to force U-frame 21 against rear surface 12 of washer 11. This expanding force is provided by the compressed spring 56 and simultaneously forces tab 41 and the corresponding downwardly extending tab associated with tab 30 against rear surface 12 of washer 11 and foot 24 and foot 25 against wall surface 32 to secure catch basket 10.

Figure 5:
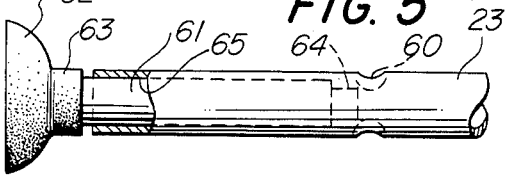
FIG. 5 is a partially sectional view of an alternate embodiment of the expansion means of the present invention catch basket.

FIG. 5 shows an alternate embodiment of the present invention in which foot 25 is replaced by a suction cup 62 which engages wall surface 32 in a manner similar to foot 25 in the embodiment of FIG. 4 and which defines a collar 63 on its reverse side. Leg 23 defines an interior passage 65 extending inwardly from one end and a reduced neck 60 which constricts passage 65. A cylindrical rod 61, which is sized to be received within passage 65, extends into collar 63 and passage 65. A compressed spring 64, similar to spring 56 in the embodiment of FIG. 4, is compressively maintained within rod 61 and imparts an expansion force between suction cup 62 and neck 60 which tends to force rod 61 outwardly from passage 65. The operation of the expansion joint shown in FIG. 5 is substantially the same as that shown in FIG. 4. The additional function of suction cup 62 is to provide a more secure attachment to wall surface 32 in the event such surface has an extremely glossy or slippery finish.

As can be seen by the foregoing descriptions, the present invention catch basket provides an advantageous solution to the problems of articles falling behind large appliances, such as a washing machine or a dryer. The catch basket shown in readily secured in place without the use of fasteners or attachments to either the appliance or the wall surface and is readily removeable therefrom for cleaning or for placement in use elsewhere.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. A catch basket, for use in combination with an appliance having a rear surface spaced from a wall surface, for preventing articles from falling into the space between said appliance rear surface and said room wall surface, said catch basket comprising:

a basket having a length and width substantially corresponding to the space between said appliance rear surface and said wall surface;

a frame supporting said basket, wherein said frame includes a substantially U-shaped rigid member, having a straight center portion and a pair of side portions extending therefrom, further including corner means attached to said straight portion for supporting said straight portion against said appliance rear surface; and expansion means securing said frame with respect to said appliance rear surface and said wall surface such that said flexible basket spans a substantial portion of the space between said appliance rear surface and said wall surface;

wherein said expansion means are coupled to said side portions and are operative to exert expansion forces away from said corner means such that said frame may be removably secured within the space between said appliance rear surface and said wall surface by oppositely directed forces against said appliance rear surface and said wall surface.

2. A catch basket as set forth in claim 1 wherein said expansion means include expandable spring cylinders having first and second ends wherein each of said first ends receives one of said end portions and each of said second ends terminates in a resilient foot.

3. A catch basket as set forth in claim 2 wherein said basket is formed of a flexible material and defines a generally rectangular upper edge secured to said U-shaped member on three sides and is elastically supported on the fourth side.

4. A catch basket comprising:

a U-shaped frame having a straight portion and first and second end portions extending therefrom;

a concave basket, having an upper edge secured to said U-shaped frame along said straight portion and said first and second end portions to form an upwardly facing receptacle; and first and second expansion means coupled to said first and second end portions respectively and terminating in first and second resilient members respectively and each operative to exert an expanding force between said first and second end portions and said first and second resilient members.

5. A catch basket as set forth in claim 4 wherein said first and second expansion means each include a tubular member configured to slidingly receive said first and second end portions and an internal spring supported within said end portions, said tubular members, said end portions, and said springs cooperating to provide telescoping ends for said U-shaped frame which are spring biased to an expanded position and compressable to a compacted position.

6. A catch basket as set forth in claim 4 wherein said first and second end portions each define center passages and wherein said first and second expansion means each include an elongated member configured to be slidingly received within said center passages of said first and second end portions and an internal spring supported within said end portions, said elongated members, said end portions, and said springs cooperating to provide telescoping ends for said U-shaped frame which are spring biased to an expanded position and compressable to a compacted position.

7. A catch basket as set forth in claim 5 wherein said U-shaped member includes a pair of outwardly facing corner brackets configured to receive an external corner.

8. A catch basket as set forth in claim 4 wherein said basket is formed of a flexible material and defines a generally rectangular upper edge secured to said U-shaped member on three sides and wherein the fourth side of said rectangular upper edge includes an elastic member stretched between said first and second end portions to elastically support said fourth side.

9. A catch basket, for use in combination with an appliance having a rear surface spaced from a wall surface, for preventing articles from falling into the space between said appliance rear surface and said room wall surface, said catch basket comprising:

expandable support means for insertion between said appliance rear surface and said wall surface securable therebetween by expansion forces exerted between said appliance rear surface and said wall surface; and a concave basket, supported by said expandable support means, sized to be received within and substantially span the space between said appliance rear surface and said wall.

10. A catch basket as set forth in claim 9 wherein said basket is formed of a flexible material and defines a flexible side elastically supported in close proximity to said wall surface.

* * * * *